United States Patent [19]

Audet

[11] Patent Number: 5,033,123

[45] Date of Patent: Jul. 23, 1991

[54] STRETCHABLE GARMENT

[75] Inventor: Jean-Pierre Audet, Coaticook, Canada

[73] Assignee: Codet, Inc., Coaticook, Canada

[21] Appl. No.: 375,631

[22] Filed: Jul. 5, 1989

[51] Int. Cl.[5] ..... A41D 1/06; A41D 1/08

[52] U.S. Cl. ..... 2/227; 2/69; 2/79; 2/80

[58] Field of Search ..... 2/227, 69, 69.5, 214, 2/78 B, 212, 213, 79, 80

[56] References Cited

U.S. PATENT DOCUMENTS

| | | | |
|---|---|---|---|
| 1,796,078 | 3/1931 | Bosworth | 2/69 |
| 1,812,791 | 6/1931 | Katz | 2/69 |
| 2,436,165 | 2/1948 | Forkish | 2/69 |
| 2,440,752 | 5/1948 | Mathews | 2/70 |
| 2,713,168 | 7/1955 | Bagnato | 2/93 |
| 2,721,326 | 10/1955 | Williamson | 2/79 |
| 3,771,169 | 11/1973 | Edmund | 2/2.1 |
| 4,089,065 | 5/1978 | McGee | 2/2 |

FOREIGN PATENT DOCUMENTS

| | | | |
|---|---|---|---|
| 996302 | 9/1976 | Canada | 2/66 |
| 6929 | of 1900 | United Kingdom | 2/408 |

*Primary Examiner*—Werner H. Schroeder
*Assistant Examiner*—Gloria Hale
*Attorney, Agent, or Firm*—Shlesinger Arkwright & Garvey

[57] ABSTRACT

There is disclosed a garment including a seat section and a pair of legs depending from the seat section in the form of trousers, and, optionally, a jacket extending up from the trousers to form a combination. The trousers have a front panel and a rear panel and the invention resides in the improvement wherein the rear panel is formed with a pair of vertical folds spaced laterally from one another with respect to the center of the panel, and wherein each fold runs down from waist level to a level at about mid-length of one of the legs so as to allow the seat portion to stretch laterally when a wearer of the garment bends down or stretches his legs laterally.

8 Claims, 2 Drawing Sheets

STRETCHABLE GARMENT

BACKGROUND OF THE INVENTION

1. Field of the invention

The present inventon generally relates to a garment which comprises a pair of trousers and, optionally, to such trousers when solid with an upper jacket to form a combination suit.

2. Description of the prior art

In such activities as lumbering and sporting where considerable body bending is involved, the seat of the trousers is subjected to important and repeated stretching unless it is made ample which is neither comfortable nor safe. Another solution which is applied is to make the trousers seat tighter but stronger so as to avoid damage particularly along the seams.

In order to assess the state of the art, a search in the relevant classes has been made which has revealed the following United States patents:

U.S. Pat. No. 1,796,078
U.S. Pat. No. 1,812,791
U.S. Pat. No. 2,436,165
U.S. Pat. No. 2,440,752
U.S. Pat. No. 2,713,168
U.S. Pat. No. 3,771,169
U.S. Pat. No. 4,089,065

Even a cursory review of the above patents easily indicates that the problem aforesaid has not been truly addressed, at least not as it is with the present invention, as is seen hereinafter.

SUMMARY OF THE INVENTION

An object of the invention is to provide a pair of trousers which avoids the above problem by making the seat stretchable and yet not ample so as to avoid the material of which they are made from being caught by tools or the like instruments used by the wearer of the trousers.

Another object is to provide such trousers which are still quite comfortable and will not hinder in any way repeated bending motions by the wearer.

Yet another object is to provide such a pair of trousers which is made solid with an upper jacket to form a combination suit.

In accordance with the invention, these objects are achieved with a garment which comprises a seat section continuing into a pair of legs and extending between waist level and ankle level, the seat section and legs thus being in the form of trousers, the latter having a planar front panel and a rear panel. The rear panel, when in a first position, having left, right and central sections. The central section lying in a plane offset from said left and right section when the rear panel is in the first position. The central section has left and right sides which are connected to the left and right sections, respectively. According to the invention, the rear panel is formed with a pair of vertical folds spaced laterally from one another with respect to the center of the panel and each fold runs down from waist level to a level at about midlength of one of said legs. In this manner, the trousers allow the seat portion to stretch laterally when a wearer of the garment bends down or stretches his legs laterally.

As an option, the garment is in the form of a combination suit which includes a jacket that extends up from and is solid with the trousers.

Other objects and advantages of the invention will become apparent from the description that follows of a preferred embodiment having reference to the appended drawings.

DESCRIPTION OF THE PREFERRED EMBODIMENT

Figure 1:
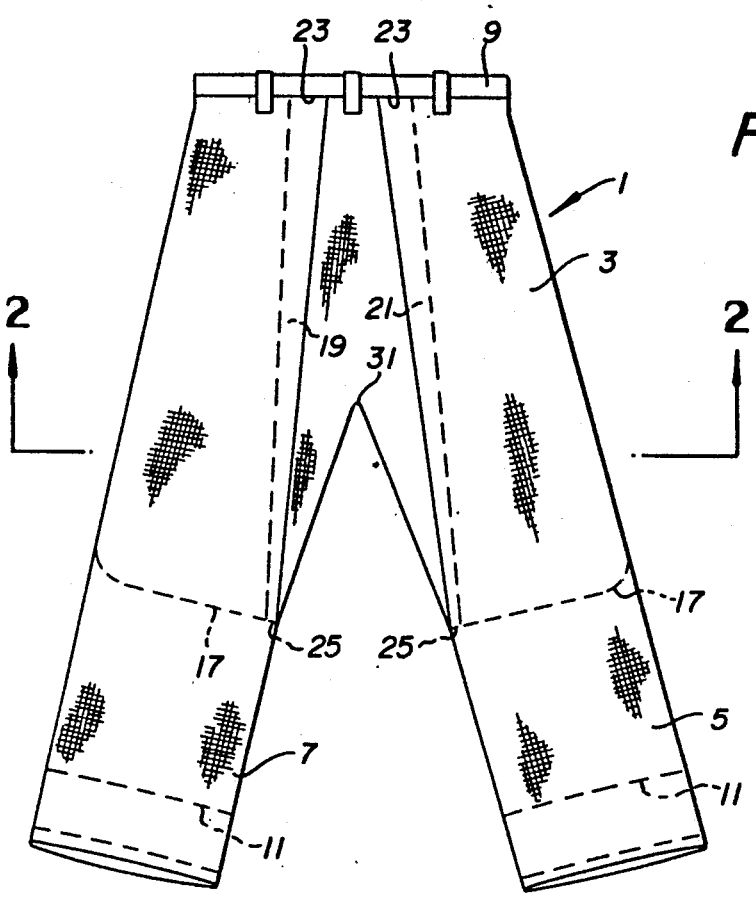
FIG. 1 is a rear elevation view of a pair of trousers including the improvement of the invention and FIG. 2 is a cross-sectional view along line II—II of FIG. 1.
Figure 2:
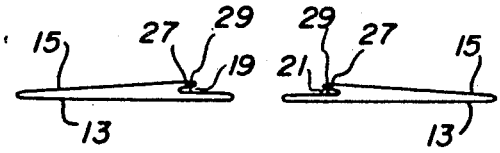

Referring to FIGS. 1 and 2, it is seen that the garment is in the form of a pair of trousers 1 having a seat section 3 which continues on into a pair of legs 5, 7; the trousers extending between the waist level 9 and the ankle level 11. They are formed of a front panel 13 and of a rear panel 15 (FIG. 2).

The trousers particularly shown here are safety trousers for use by lumbermen and, for that purpose, the whole front panel 13, from the waist level 9 down to the ankle level 11, is padded with tough plastic fiber material to aid in reducing injuries to workers using chain saws by having the fibrous material fill the teeth of the chain, causing the saw to stop. The rear part of the legs 5, 7 between the level 17 at about mid-length of the legs, and the ankle level 11 may also be padded for greater safety. However, as will be gathered, the invention is not restricted to this specific use and construction.

Figure 3:
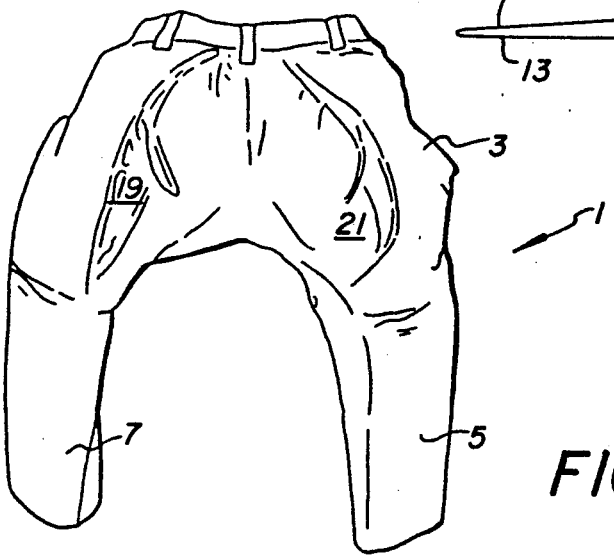
FIGS. 3 and 4 are rear elevation view of the trousers of FIG. 1 seen in bent down and laterally streched positions, respectively.
Figure 4:
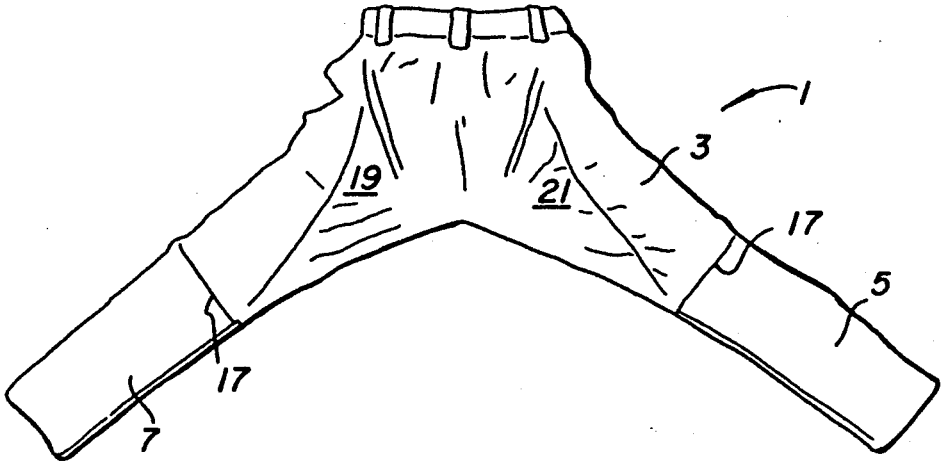

In accordance with the invention, the rear panel 3 is formed With a pair of vertical folds 19, 21 laterally spaced from one another with respect to the center of the panel to create a left section, a right section and a central section lying in a plane offset from the left and right section. Vertical folds 19 and 21 extend substantially parallel. As shown, each fold runs down from the waist level 9 to about the mid-length level 17. With this construction, the seat portion 3 of the trousers is allowed to stretch laterally when the wearer bends down or stretches his legs laterally as best seen in FIGS. 3 and 4. Yet, in upright position, the garment does not have any looseness or ampleness, at the seat, as shown in FIG. 1, thus avoiding discomfort and, more important, reducing the possibility of accidents, as reported above.

The folds 19, 21 should preferably be opened toward one another in the manner illustrated in FIG. 2.

In FIG. 1, it is seen that each fold, in upright position of the trousers, has the shape of an elongated quadrilateral running lengthwise of the rear panel 15 and having a wide base 23 at the waist level 9 and a narrow base 25 at the mid-length level 17. Each such fold is made up of an outer band 27 and an inner band 29 (FIG. 2) that are stitched together along the wide and narrow bases 23, 27 respectively. They extend also on either side of the nick 31 of the trousers.

Figure 5:
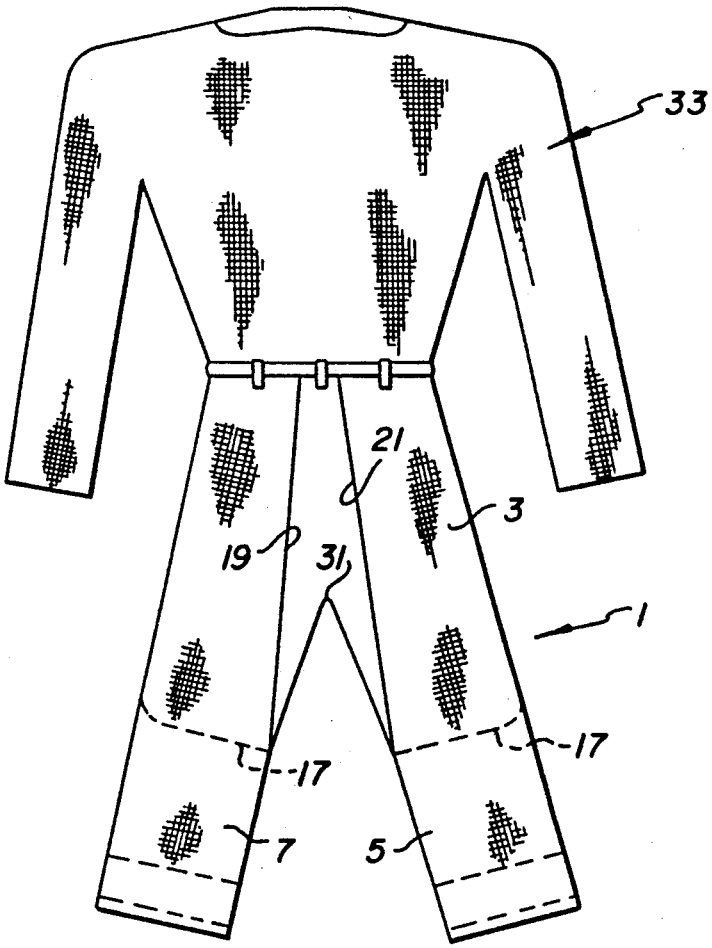
FIG. 5 is a rear elevation view of trousers as in the previous Figures but solid with an upper jacket to form a combination suit.

In the option of FIG. 5, the trousers 1 are seen joined to a jacket 33 to form a combination suit. The joining may be by means of a slide fastener or otherwise or the two parts 1 and 23 may be a one-piece construction.

What is claimed is:

1. Trousers formed of two panels comprising:

a) a planar front panel comprising a continuous front waist portion and front leg portion;

b) an interrupted rear panel including a rear waist portion and rear leg sections;

c) said rear panel having a first position and a second position;

d) said front panel and said rear panel when it its first position overlie each other and have corresponding outlines;

3) said rear panel including left, right and central sections; said central section lying in a plane offset from said left and right sections when said rear panel is in its first position;

f) said central section having left and right sides connected correspondingly to said left and right sections to form folds extending substantially parallel and spaced laterally from one another.

2. A garment as claimed in claim 1, wherein said folds open toward one another.

3. A garment as claimed in claim 1, wherein said folds are each made up of an outer band and an inner band and said bands are stitched together along said wide and narrow bases.

4. A garment as claimed in claim 3, wherein said folds extend on either side of the nick of said trousers, between said legs.

5. A garment as claimed in claim 4, wherein said folds open toward one another.

6. A garment as claimed in claim 1, in the form of a combination suit including a jacket extending up from an integral with said trousers.

7. A garment as claimed in claim 6, wherein said folds open toward one another.

8. A garment as claimed in claim 5, in the form of a combination, suit including a jacket extending up from an integral with said trousers.

* * * * *